United States Patent [19]

Kobata

[11] Patent Number: 4,854,753

[45] Date of Patent: Aug. 8, 1989

[54] PRINTER

[75] Inventor: Yoshihiro Kobata, Tokyo, Japan

[73] Assignee: Canon Kabushiki Kaisha, Tokyo, Japan

[21] Appl. No.: 139,080

[22] Filed: Dec. 23, 1987

Related U.S. Application Data

[63] Continuation of Ser. No. 861,112, May 6, 1986, abandoned, which is a continuation of Ser. No. 582,560, Feb. 22, 1984, abandoned.

[30] Foreign Application Priority Data

Feb. 25, 1983 [JP] Japan ..... 58-31170

[51] Int. Cl.[4] ..... B41J 1/04

[52] U.S. Cl. ..... 400/144.2; 400/175; 400/692

[58] Field of Search ..... 400/175, 55, 56, 144.2, 400/692

[56] References Cited

U.S. PATENT DOCUMENTS

| | | | |
|---|---|---|---|
| 3,960,255 | 6/1976 | Bisson et al. | 400/120 |
| 3,988,744 | 10/1976 | Noda | 400/120 |
| 4,049,109 | 9/1977 | Plasa et al. | 400/144.2 X |
| 4,229,114 | 10/1980 | Van Horne | 400/692 |
| 4,239,402 | 12/1980 | Jung et al. | 400/692 X |
| 4,350,448 | 9/1982 | Hanagata et al. | 400/175 X |
| 4,403,876 | 9/1983 | Vought | 400/175 |
| 4,410,288 | 10/1983 | Holmes, Jr. | 400/175 |
| 4,473,312 | 9/1984 | Förschner | 400/175 |
| 4,503,442 | 3/1985 | Barbero et al. | 400/126 |
| 4,516,867 | 5/1985 | Schacht | 400/175 |
| 4,530,611 | 7/1985 | Borcenk et al. | 400/126 |

FOREIGN PATENT DOCUMENTS

| | | | |
|---|---|---|---|
| 3209083 | 9/1982 | Fed. Rep. of Germany | 400/692 |

OTHER PUBLICATIONS

Steyr Roller Bearings, General Catalog 269E, 1969, p. 36.

*Primary Examiner*—William Pieprz

*Attorney, Agent, or Firm*—Fitzpatrick, Cella, Harper & Scinto

[57] ABSTRACT

A printer comprises print means for printing on a print medium in accordance with a print command; guide and hold means for guiding the print means toward a print surface of the print medium with a print surface of the print means facing the print surface of the print medium and for holding the print means at the guided position; and actuation means for pressing the print means substantially normally to the guide direction of the guide and hold means to resiliently fit to a positioning area formed on the print means and fix the print means at a print position.

10 Claims, 3 Drawing Sheets

PRINTER

This application is a continuation of application Ser. No. 861,112 filed 5/6/86, which is a continuation of Ser. No. 582,560, filed 2/22/84 both abandoned.

BACKGROUND OF THE INVENTION

1. Field of the Invention

The present invention relates to a printer which prints on a print medium by a print command.

2. Description of the Prior Art

Printers can be is classified as impact printers which print by impacting a print paper by a hammer and non-impact printers which print without impacting the print paper. In any type of printer, it is very important to precisely fix a print head at a print position. An impact printer has a large impact force as compared to a non-impact printer such as a thermal printer and an ink jet printer, and hence it is necessary to rigidly fix the print head at a position displaced from a platen by a predetermined distance. A known impact printer has a daisy print wheel head which has types mounted at ends of a number of radial spokes and which is rotated at a high speed, and the printer actuates a print hammer when a selected type comes to a predetermined print position to impact the type to print a character on a print paper on a platen.

FIGS. 1 and 2 show an example of a daisy-type printer. Numeral 1 denotes a daisy-type wheel which is the heart of a print head and has types such as alphabetic and numeric characters mounted at ends of radially extending spokes. The type wheel is fixed to a rotary shaft 2 of a wheel motor (not shown) and is rotatable in both directions. Numeral 3 denotes a motor case having the wheel motor accommodated therein, and pins 4 and 5 are mounted on side surfaces thereof. Numeral 6 denotes a mounting frame fixed on a carriage, not shown, and grooves 7 for guiding the pins 4 and grooves 8 for guiding the pins 5 are formed on both side surfaces of the frame. A magnet device having a yoke 9 and a permanent magnet 10 is fixed to the bottom of the motor case 3 and attaches by an attraction force to a yoke 12 rotataby mounted to the mounting frame by a shaft 11 to fix the motor case 3 at a print position, that is, a position at which the type wheel 1 faces a platen, not shown.

In such a prior art printer, high precision is required for both contact surfaces of the permanent magnet 10 and the yokes 9 and contact surfaces of the yokes 9 and the yoke 12 in order to precisely fix the impact print head at the print position, and a fine adjustment is required to form one plane by end surfaces of the yokes 9 contacting to the yoke 12.

SUMMARY OF THE INVENTION

It is an object of the present invention to provide a printer which can precisely fix a movably held print head at a print position.

It is another object of the present invention to prc-vide a printer having a simple structure.

It is still another object of the present invention to provide a printer which has biasing means for precisely holding a print head at a print position and a retracted position.

It is yet another object of the present invention to provide a printer which can rigidly fix a print head and readily retract the print head.

It is a still further object of the present invention to provide a printer which requires a low part precision and a low assembling precision.

Other objects of the present invention will be apparent from the following description of the invention.

DETAILED DESCRIPTION OF THE PREFERRED EMBODIMENTS

Figure 1:
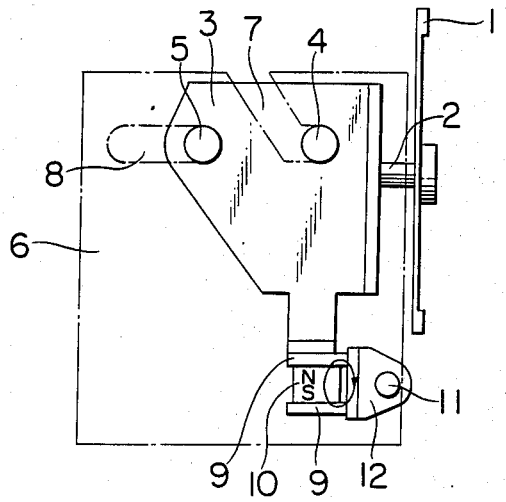
FIG. 1 PRIOR ART
FIGS. 1 and 2 show a prior art printer.
Figure 2:
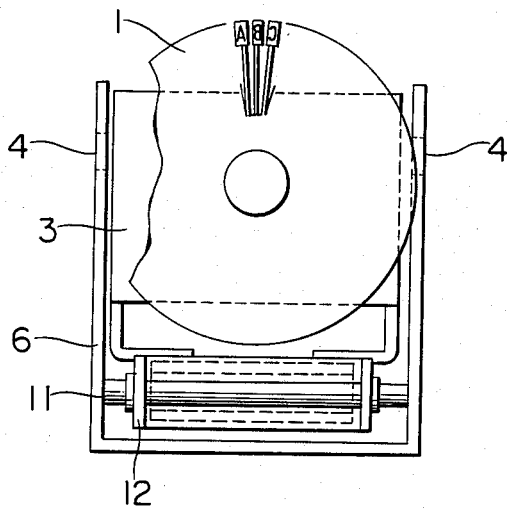
FIG. 2 PRIOR ART
Figure 3:
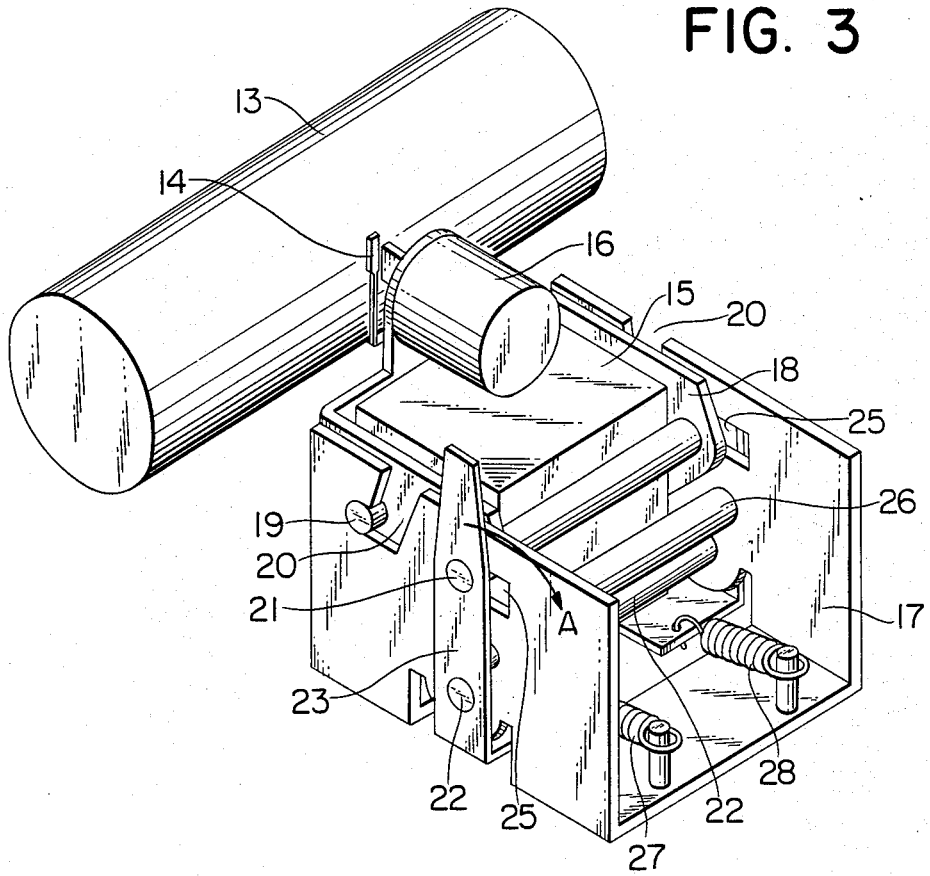
FIG. 3 is a perspective view of one embodiment of the present invention.

FIG. 3 shows a printer in accordance with one embodiment of the present invention, which has a daisy print head as a print means. Numeral 13 denotes a platen around which a print paper (not shown) is wrapped. Arranged in front of the platen 13 is a print head including a daisy type wheel 14, a motor 15 for rotating the wheel 14 and a hammer 16 for striking a type of the type wheel 14 in response to a print command to transfer ink of an ink ribbon (not shown) to a print paper. The print head is guided and held by a guide and hold mechanism mounted on a carriage (not shown) and selectively brought toward or away from the platen. The guide and hold mechanism includes a holding frame 17 fixed on the carriage. Numeral 18 denotes a U-shaped motor case which accommodates therein the motor 15 for rotating the type wheel 14, and it forms a part of the print head. The hammer 16 is fixed at the top of the motor case 18. Guide pins 19 are formed on both side surfaces of the motor case 18 and they fit into guide grooves 20 formed in both sides of the frame 17. One end of each guide groove 20 is open and the other end engages with the pin 19 to hold the print head at the print position. A shaft 21 extends through the both sides of the motor case 18 and is fixed thereto, and the opposite ends of the shaft 21 rotatably fit to an actuation lever 23 and a lever 24 which are pivotably mounted to the frame 17 by a shaft 22. Grooves 25 for guiding the shaft 21 are formed in the frame 17. Numeral 26 denotes an engaging lever extending across the both sides of the frame 17. When the actuation lever 23 is rotated in a direction A, a print surface of the print head faces a print plane of the print paper on the platen 13 and the print head is linearly moved away from the print paper. As the head is moved in this manner, the end surface of the motor case 18 engages with the engaging lever 26 and is held at a first retracted position. As the actuation lever 23 is further rotated, the print head is rotated clockwise in FIG. 3 and held at a second retracted position for exchange of the wheel 14.

Numerals 27 and 28 denote coil springs each having one end thereof fixed to the lever 24 and the other end fixed to the frame 17 to normally bias the print head toward the platen 13.

Figure 4:
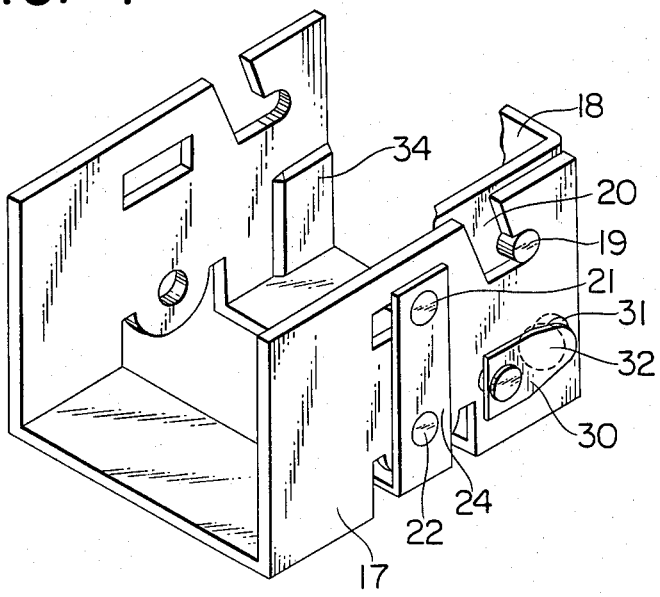
FIG. 4 is a perspective view of a mounting frame.

FIG. 4 shows the opposite side of the frame 17. A leaf spring 30 is fixed to one side of the frame 17 and a steel ball 32 which is a rotatable member is pressed into the frame 17 through a hole 31 formed in the frame 17. The steel ball 32 and the leaf spring 30 form biasing means and the biasing direction thereof is substantially normal to a direction along which the print plane of the type wheel 14 is brought toward or away from the print plane of the print paper on the platen.

Figure 5A:
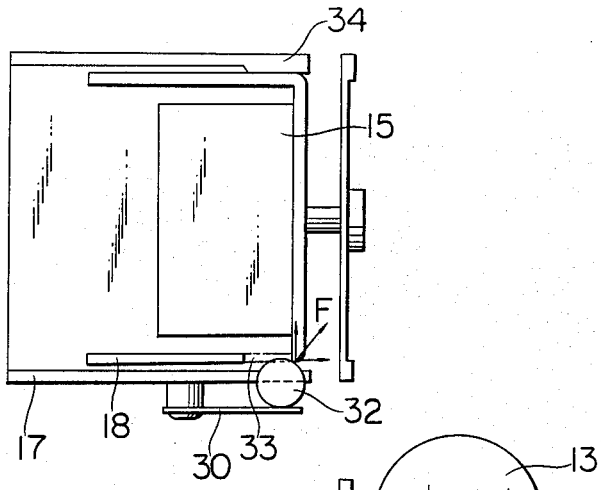
FIGS. 5–7 illustrate operations.
Figure 5B:
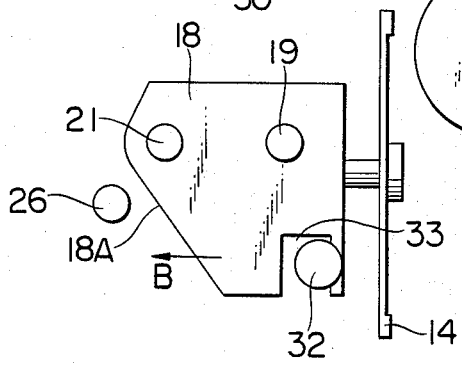

A notch 33 for positioning the motor case 18 relative to a frame 17 is formed in the motor case 18 at a position facing the steel ball 32 as shown in FIG. 5, and the steel ball 32 is pressed into the notch 33. The press-inserted steel ball 32 presses an end surface of the notch 33 of the motor case 18 by a force F. This force F rigidly presses the motor case 18 against a projection 34 formed on the other side of the frame 17, biases the motor case 18 toward the platen 13 and rigidly presses the guide pin 19 of the motor case 18 into the guide groove 20 of the frame 17.

It is advantageous for several reasons to press the motor case 18 against the projection 34 rather than directly against the side of the frame 17. First, the contact surface on the frame 17 for the motor case 18 determines the location of the print head, and since the projection 34 can be made to have a very small contact area, only that small area has to be located with precision to precisely locate the print head. It is desirable that the print head is rigidly fixed at the print position and can be retracted to the retracted position without resistance. If the motor case 18 contacts to the projection 34 of the frame 17 only when it is at the print position, the actuation force to retract the print head may be made small. In this manner, the motor case 18 is precisely and rigidly fixed to the frame 17 and hence the print head is precisely and rigidly fixed at the print position.

The contact of the steel ball 32 and the motor case 18 is preferably a point contact so that the force F by the spring 30 is effectively used to fix the print head.

Exchange of the type wheel 14 is now explained. The print head fixed at the print position as shown in FIG. 5 is linearly retracted in a direction B by rotating the actuation lever 23 in a direction A, as the print head is retracted, the steel ball 32 rides over the end surface of the notch 33 of the motor case 18. As the steel ball 32 rides over the end surface of the notch, the spring 30 generates a force that urges the motor case 18 in the direction B and the cam surface 18A at the rear end of the motor case 18 thus abuts against the engaging lever 26.

In this manner, the biasing means comprising the steel ball 32 and the spring 30 applies the pressing force to fix the print head at the print position and genertes the pressing force to stop the print head at the first retracted position when the print head is retracted. Accordingly, the print head is moved with a click-stop feeling.

Figure 6:
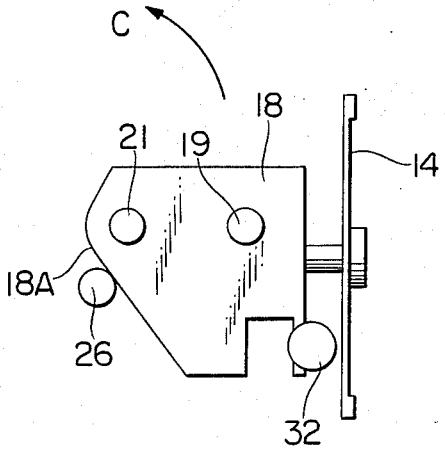

FIG. 6 shows the print head at the first retracted position. When the actuation lever 23 is further rotated in the direction A, the print unit is rotated in a direction C while it slides on the engaging lever 26 along the cam surface 18A.

Figure 7:
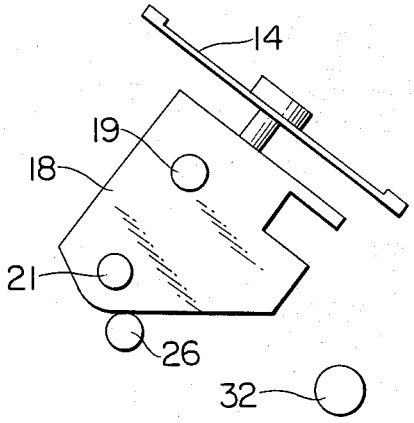

FIG. 7 shows the actuation lever 23 rotated in the direction A to its limit. At this position, the guide pin 19 of the motor case 18 is completely out of the guide groove 20 of the frame and the type wheel 14 is essentially oriented upward. This is the second retracted position of the print head. At this position, the biasing forces of the coil springs 27 and 28 to rotate the print head in a direction opposed to the direction of the arrow C are cancelled by the weight of the print head and the print head is stably stopped at the position shown in FIG. 7. At this position, the type wheel can be exchanged and the actuation lever 23 is then rotated in a direction opposite to the direction of the arrow A. Thus, the opposite operation to that described above is carried out and the print head is returned to the print position shown in FIG. 5 and precisely and rigidly fixed at that position.

The present invention is not limited to the illustrated embodiment. It is applicable not only to the printer having the daisy print unit but also to a printer having a different impact print unit. The steel ball 32 in the embodiment may be a rotary member such as a roller.

What I claim is:

1. An impact printer comprising:

a frame having an open front, a first side wall and a second side wall, said first and second side walls being perpendicular to said front and parallel to each other;

a print mechanism removably mounted to said frame for printing on a print medium in accordance with a print command, said print mechanism having a positioning guide on one side, wherein said print mechanism can be moved in a direction parallel to said side walls and between a print position and a retracted position;

a frame member located on said first side wall of said frame for positioning said print mechanism tightly at said print position and loosely at said retracted position, wherein said frame member consists of a projection formed on said first side wall of said frame, said projection having a major substantially planar surface smaller in area than said first side wall, and said major surface being finished with a predetermined precision relative to said first side wall sufficient to position said print mechanism; and actuation means located on said second side wall of said frame for pressing said print mechanism against said major surface of said projection in a direction substantially normal to the impact direction of said print mechanism, wherein said actuation means consists of a rotatable member connected to said print mechanism for moving the print mechanism and a plate spring member to resiliently urge said rotatable member into said positioning guide for fixing said print mechanism at said print position, wherein said projection is located so as to contact said print means tightly at said print position and contact said print means loosely at said retracted position.

2. An impact printer according to claim 1, wherein said actuation means makes point contact with said print mechanism in the print position.

3. An impact printer according to claim 1, wherein said actuation means functions with a click-stop feeling when positioning said print mechanism.

4. An impact printer comprising:

a frame having a first side wall and a second side wall, said first and second side walls being parallel to each other;

a print mechanism having types and a motor for selecting one of the types for printing on a print medium in accordance with a print command, wherein said print mechanism can be moved in a direction parallel to said side walls and between a print position and a retracted position;

a frame member including a projection formed on said first side wall for holding said print mechanism, said projection having a major substantially planar surface smaller in area than said first side wall, and said major surface being finished with a predetermined precision relative to said first side wall sufficient to position said print mechanism; and engaging means, including a plate spring member and a rotatable member, for pressing said print mechanism against said major surface in a direction substantially normal to the impact direction of the print mechanism, wherein said projection is located so as to contact said print mechanism tightly at said print position and contact said print mechanism loosely at said retracted position such that a force applied to said print mechanism by cooperation of said engaging means and said major surface is strong at said print position and weak for easy release at said retracted position.

5. An impact printer according to claim 4, wherein said rotating member engages a recess in said print mechanism in the print position and said spring member presses said rotatable member toward said recess.

6. An impact printer according to claim 5, wherein when said rotatable member is moved from said recess against the force of said spring member by moving said print mechanism relative to the print medium for a predetermined distance, said spring member generates through said rotatable member a force driving said print mechanism further away from the print medium.

7. An impact printer according to claim 4, wherein said print mechanism includes an impact print head having a hammer.

8. An impact printer comprising:

a frame having a first side wall and a second side wall, said first and second side walls being parallel to each other and an engaging lever extending across said first side wall and said second side wall;

a print mechanism having types and a motor for selecting one of the types for printing on a print medium in accordance with a print command, wherein said print mechanism can be moved in a direction parallel to said side walls between a print position and a retracted position and wherein said print mechanism is stopped at the retracted position by engaging said engaging lever;

a frame member including a projection formed on said first side wall for holding said print mechanism, said projection having a major substantially planar surface smaller in area than said first side wall, and said major surface being finished with a predetermined precision relative to said first side wall sufficient to position said print mechanism; and engaging means including a spring member and a rotatable member for pressing said print mechanism against said major surface, wherein said projection is located so as to contact said print mechanism tightly at said print position and contact said print mechanism loosely at said retracted position such that a force applied to said print mechanism by cooperation of said engaging means and said major surface can be strong at said print position and weak for easy release at said retracted position and wherein said print mechanism is held by said engaging means and said projection so that said print mechanism is stably held at the print position by making point contact with said rotatable member and making face contact with said major surface of said projection in a direction substantially normal to the impact direction of said print mechanism.

9. An impact printer according to claim 8, wherein said print mechanism includes an impact print head having a hammer.

10. An impact printer according to claim 8, wherein said engaging means functions with a click-stop feeling when positioning said print mechanism.

* * * * *

UNITED STATES PATENT AND TRADEMARK OFFICE

CERTIFICATE OF CORRECTION

PATENT NO. : 4,854,753

DATED : August 8, 1989

INVENTOR(S) : Kobata

It is certified that error appears in the above-identified patent and that said Letters Patent is hereby corrected as shown below:

COLUMN 1

Line 44, change "rotataby" to --rotatably--.

COLUMN 3

Line 34, change "direction A," to --direction A. As--; and
Line 44, change "genertes" to --generates--.

COLUMN 5

Line 17, change "said rotating member" to --said rotatable member--.

Signed and Sealed this

Twenty-fifth Day of September, 1990

*Attest:*

HARRY F. MANBECK, JR.

*Attesting Officer*

*Commissioner of Patents and Trademarks*